US011179592B2

(12) United States Patent
Oliveira et al.

(10) Patent No.: US 11,179,592 B2
(45) Date of Patent: Nov. 23, 2021

(54) MOBILE TRAINING APPARATUS FOR RECEIVING WEIGHTS

(71) Applicants: Michael Oliveira, Wallisellen (CH); Nuno Miguel Da Silva Santos, Wallisellen (CH)

(72) Inventors: Michael Oliveira, Wallisellen (CH); Nuno Miguel Da Silva Santos, Wallisellen (CH)

( * ) Notice: Subject to any disclaimer, the term of this patent is extended or adjusted under 35 U.S.C. 154(b) by 134 days.

(21) Appl. No.: 16/493,787

(22) PCT Filed: Mar. 15, 2018

(86) PCT No.: PCT/IB2018/051742
§ 371 (c)(1),
(2) Date: Oct. 17, 2019

(87) PCT Pub. No.: WO2018/167708
PCT Pub. Date: Sep. 20, 2018

(65) Prior Publication Data

US 2021/0077847 A1 Mar. 18, 2021

(30) Foreign Application Priority Data

Mar. 15, 2017 (DE) ..... 10 2017 105 574.6

(51) Int. Cl.
*A63B 21/065* (2006.01)
*A63B 21/06* (2006.01)

(52) U.S. Cl.
CPC ..... *A63B 21/065* (2013.01); *A63B 21/0605* (2013.01); *A63B 2209/08* (2013.01)

(58) Field of Classification Search
CPC ..... A63B 22/00; A63B 2022/0094; A63B 2022/0035; A63B 22/0025;
(Continued)

(56) References Cited

U.S. PATENT DOCUMENTS 5,120,288 A 6/1992 Sinaki
6,669,608 B1 * 12/2003 Winston ..... A63B 21/065 2/102
(Continued)

FOREIGN PATENT DOCUMENTS

DE 20 2014 1 00 859 U1 6/2014
WO 99/56831 A1 11/1999
(Continued)

OTHER PUBLICATIONS

International Search Report in PCT/IB2018/051742, dated Jun. 13, 2018.

*Primary Examiner* — Nyca T Nguyen
*Assistant Examiner* — Andrew M Kobylarz
(74) *Attorney, Agent, or Firm* — Collard & Roe, P.C.

(57) ABSTRACT

A mobile training apparatus for receiving weights, in particular for sports activities, is composed of a back element and, articulated releasably on the latter, a carrying system with shoulder straps, and receiving regions for at least one weight are present on the back element and/or on the carrying system, wherein the back element extends from one end of the shoulder straps as far as the articulation at the pelvis strap. The back element is configured as a plate and can be divided into several plate parts, wherein the plate parts are releasably and separably connected to each other by a connecting element, and each plate part and/or the carrying system has at least one receiving region for receiving a weight or a weight plate.

4 Claims, 9 Drawing Sheets

Figure 1:
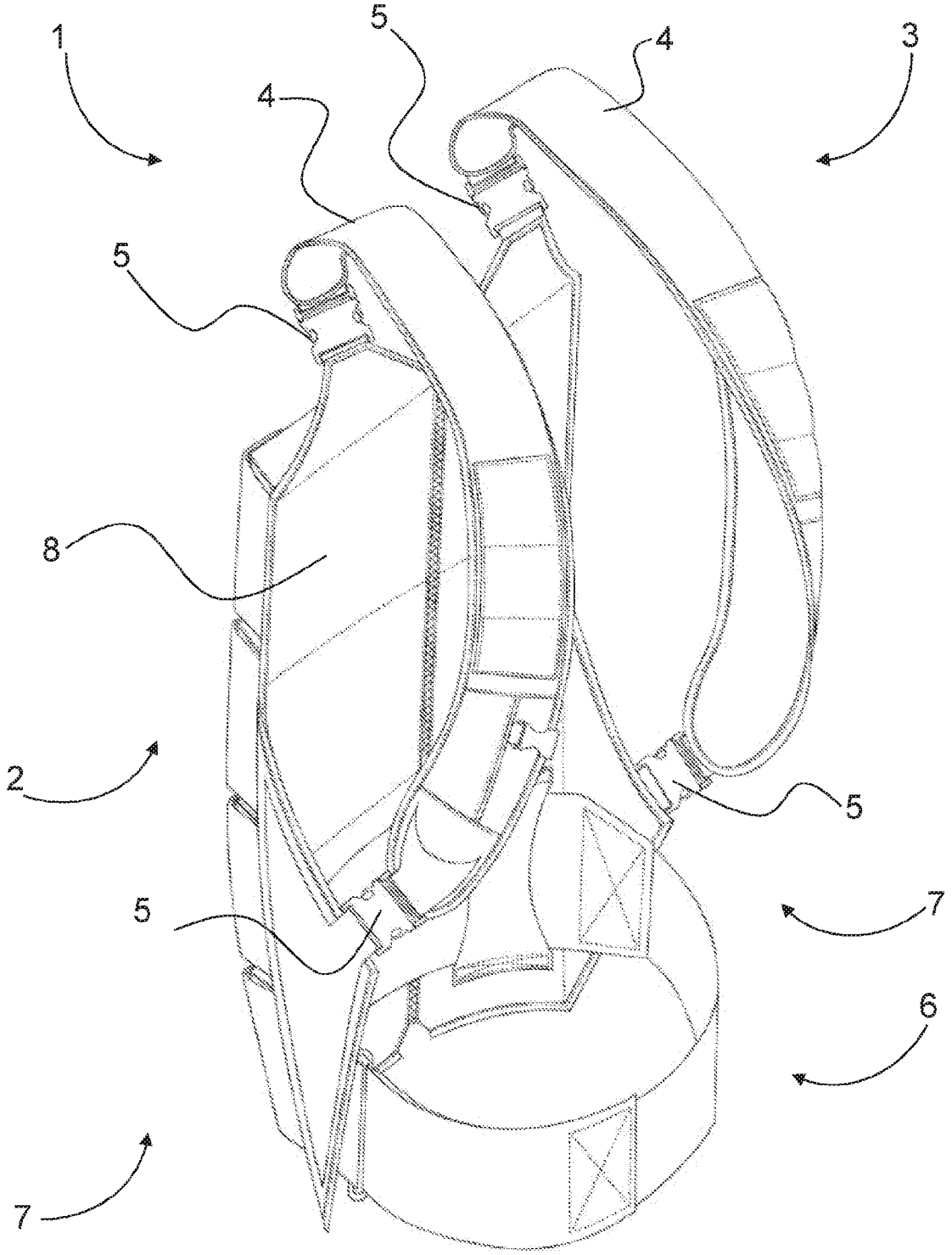

(58) Field of Classification Search
CPC ..... A63B 21/4001; A63B 21/4007; A63B 21/4005; A63B 21/40
See application file for complete search history.

(56) References Cited

U.S. PATENT DOCUMENTS

| | | | | |
|---|---|---|---|---|
| 10,543,388 | B2 * | 1/2020 | Rachele | A63B 21/0722 |
| 2006/0229173 | A1 | 10/2006 | Foley | |
| 2015/0342329 | A1 * | 12/2015 | Formosa | A45F 3/08 224/666 |

FOREIGN PATENT DOCUMENTS

| | | | |
|---|---|---|---|
| WO | 2014/096797 | A1 | 6/2014 |
| WO | 2017/019512 | A1 | 2/2017 |

* cited by examiner

MOBILE TRAINING APPARATUS FOR RECEIVING WEIGHTS

CROSS REFERENCE TO RELATED APPLICATIONS

This application is the National Stage of PCT/162018/051742 filed on Mar. 15, 2018, which claims priority under 35 U.S.C. § 119 of German Application No. 10 2017 105 574.6 filed on Mar. 15, 2017, the disclosure of which is incorporated by reference. The international application under PCT article 21(2) was not published in English.

TECHNICAL FIELD

The invention relates to a mobile training device for holding weights, in particular for athletic activity, wherein the training device consists of a back element and a carrying system having shoulder straps, releasably articulated onto this element, and holding regions for at least one weight exist on the back element and/or on the carrying system, wherein the back element extends from the one end of the shoulder straps up to the articulation on the hip belt.

Definition

A training device is understood to be a sports device having a defined intended purpose. This is an object that can consist of multiple parts, under some circumstances, and is used to perform a type of sport or for training purposes. This serves for training of specific capabilities that are required for performing a type of sport. In this connection, this can mean, for example, a treadmill for training endurance for running. Or also a home trainer for power training or for targeted training of specific muscle groups, which is known to many people. Thus the training devices generally cannot be assigned to a specific type of sport. For example, dumbbells can be used for training purposes both by a strength athlete and by a swimmer. Among other things, the intent and purpose of the training devices is also that of training specific capabilities under all weather conditions or at any time of day. A further function of these devices can also be to support reinforcement or faster achievement of the training result. Thus, a strength athlete achieves faster growth of his biceps, for example, by means of training with a dumbbell.

STATE OF THE ART

Carrying systems for backpacks are known in the most varied embodiments and variants. These are suitable for holding a small backpack for a short hike up to a backpack having a very large volume and pockets or compartments.

A common feature of almost all backpacks is a carrying system with which they can be carried on the back of a person. In this regard, part of the backpack lies against the back of the wearer, and the backpack is held on the wearer's back by means of two carrying straps or shoulder straps, over the wearer's shoulders. Very often, backpacks furthermore possess a belt around the waist or abdomen of the wearer, so as to improve the position of the backpack. In the case of contact of the backpack surface with the wearer's back, different variants of cushioning and ventilation are known. Essentially, a distinction is made between the variant with full-surface contact with the back and a variant having a certain distance from the back.

The full-surface contact back, also called a back plate, in the case of which the weight lies directly on the back and is distributed over the entire back has the advantage that the backpack weight can be carried in the most ergonomic manner possible and close to the body. In this method of carrying, the center of gravity of the load lies closer to the center of gravity of the body, and this allows more upright and more ergonomic walking and improves body balance in rough terrain.

If such a carrying system is used for a backpack that is filled with weights for physical training purposes, then the center of gravity of the overall weight shifts in such a manner that it lies far removed from the body axis, so that a momentum that has a negative influence on the skeleton structure of the user acts on this structure.

Thus, for example, a carrying system is known from U.S. Pat. No. 5,120,288, which is suitable for holding a backpack-like receptacle. This receptacle serves to hold weights so as to achieve a training purpose while running or jogging. Due to the placement of the receptacle together with the weights, a change in the center of gravity of the overall weight occurs and leads to additional stress on the body structure, in particular of the skeleton structure.

A further disadvantage consists in that this apparatus can be worn and used exclusively for this purpose. The non-needed weights must be stowed away separately.

In the sector of power sports and fitness, free weights such as dumbbells and barbells, above all, have established themselves. In the meantime, solutions that go beyond this have become known, such as, for example, the Powerbag or the Ultimate Sandbag, which serve for athletic strength and coordination training with free weights. In the case of these solutions, the supporting musculature can be subjected to stress to a greater extent than in the case of working with traditional weights, for example due to the presence of structural instability. For example, Powerbags are partially filled with a sand filling that randomly shifts during exercise. This requires great stabilization effort during lifting. However, previous solutions in the sector of free weights have the disadvantage that more and more versions and/or sizes are needed by the user, since the inherent weight of the products cannot be variably adjusted at all, or can only be adjusted in limited manner.

Thus, for example, a container for introduction of loads, suitable for such training purposes, is known from DE 20 2014 100 859 U1. The apparatus relates to a universally usable, mobile container for introduction of loads, in particular for athletic activity and for transport of loads, wherein the container has at least one corpus surrounded by walls, which corpus can be loaded with loads having the most varied consistency, wherein a carrying system consisting of belts, straps or the like is provided on at least one wall. The present invention particularly serves for general resistance training in the sector of power sports and fitness, and is used in the sector of sports, fitness, mountaineering, hiking, and in all other sectors in which loads must be moved using the musculature.

If this container is worn in the manner of a backpack, the center of gravity of the weight of the container is far removed from the center of gravity of the body. As a result, momentums and stresses result from the structure of the body and skeleton, and these can have negative consequences.

A backpack-like training device is known from US 2006/0229173 A1. This training device comprises a closable container, which is equipped with weights, and a carrying system with which the container can be carried in the manner of a backpack. Weights in the configuration of dumbbells, kettlebells and weight disks are arranged in the container.

A carrying system is known from WO 99/56831 A1, to which weights can be affixed on the strap elements. In this regard, the shoulder straps have holding regions for the weights. Furthermore, the hip belt is structured in such a manner that it can also hold weights.

A weight vest that consists of a belt and/or an assembly plate is described in WO 2014/096797 A1. The carrying belt comprises an elongated strap connector, a stabilization insert at the back of the belt, and, of course, weights. These weights can be introduced into one or more holding elements, wherein the holding elements can be affixed to the vest by way of clamps.

An exercise apparatus is described in WO 2017/019512 A1, which contains self-coupling weight capsules, which couple with one another so as to form what are called weight clusters. These weight clusters can be used by a user for training purposes.

Each weight block typically has a calibrated weight. Each weight element contains one or more coupling functions, which make it possible for one or more weight elements to be connected with one another. In some embodiments, each weight element is soft, so as to prevent injuries to a user. The weight elements can be used with one or more accessory parts, such as, for example, a strap, a bag that imitates a "kettle ball," and a backpack.

Task of the Invention

The task of the invention consists in creating a training device with which weights can be carried, in particular for athletic and training purposes, and can also be used in other positions.

Solution of the Task

The solution of the task is made available by means of a training device that has the characteristics of claim 1.

Advantages of the Invention

It is the basic idea of the invention that the weights that are carried or lifted for athletic exercise and training can be arranged in such a manner, using the carrying system, that they can be arranged very close to the body so as to prevent damage to the body structure or skeleton structure from occurring due to projecting loads. A particular embodiment provides that the weights can be arranged symmetrically relative to the body axis, so that no or only a slight momentum occurs.

The carrying system is structured in such a manner that holding regions are provided on the shoulder straps, which regions can be provided with weights. These can be placed, for example, into small containers intended for this purpose, having magnets or hook-and-loop closures to close them. These containers consist of durable textile material or of plastic boxes, so that this system can assume a small shape. Furthermore, these containers can have the property that they adapt to the shape of the weights, or the weights adapt to the structure of the containers. Placement of the weights takes place very close to the body. In addition, this arrangement takes into account the circumstance that weights are arranged on the "opposite" side of the usual placement in the back region, so that the sum of the momentums generated by the weights, with reference to the body axis, cancel each other out, at least in part. It is an intended aim that these momentums are be as small as possible. For this reason, placement on the shoulder straps is also intended.

The shoulder straps are arranged on a back element. The back element can consist, for example, of a plate composed of plastic or of a viscoelastic foam, which is preferably encircled by a plastic, on which the weights can be affixed in any desired manner, for example by means of magnets. Alternatively, containers can also be provided into which weights, for example sand can be introduced. Alternatively, it can also be provided that the weights are structured in plate shape and can be inserted into box regions that are provided. The plate-like weights are held in the box regions by means of fixation elements, for example magnets or clamping elements.

These containers are structured in such a manner that they lie closely against the back element. As a result, a wide distance from the back element and thereby from the body axis when being worn is prevented.

With regard to the design layout of the carrying system, experience from backpacks is used, but with the difference that weights can be affixed directly on the back element and directly on or in the shoulder straps, and also on or in a hip belt, in each instance with the goal of affixing the weights close to the body. Furthermore, it is an aim to structure the entire momentum, with reference to the center axis of the body, as low as possible, in that forces of similar size act on the carrier system on both sides of the center axis of the body. For this purpose, it is necessary to arrange the weights required for this purpose also in the region of the shoulder straps and of the hip belt.

An advantageous further development provides that one or more containers can be affixed on the back element. It is advantageous if these containers have different holding regions for weights.

Another further development provides that the containers that can be affixed on the back element, for example by way of a zipper, can be released from there. The handles arranged on the container bring with them the possibility of using the container as a weight element, so as to perform exercise outdoors.

The shoulder straps and the hip belt are preferably structured so that they can be released from the back element.

Depending on the user, weights that differ in weight can be introduced or affixed, depending on the user, so as to carry out optimal and efficient physical training.

Furthermore, the back element has the property that it can be divided in terms of its longitudinal expanse. Means of division, such as a zipper, for example, bring with them the possibility that two mobile weights of equal size are formed, with which further training exercises can be performed. Also, one or more containers are arranged on part of the back element, which containers can be filled with the plate-like weights. Part of the back element can also be structured as a kettlebell by means of simple folding and fixation. Alternatively, the part can be affixed to an arm or leg as a fixed weight by means of corresponding fixation means, which are part of this part of the back element.

The carrying system is therefore suitable as a training device that can be used for everyone for location-independent and efficient whole-body training. Whether at home, by a lake or in the woods, the training location can be freely determined by the user or personal trainer, since the carrying system, together with the weights, makes available a functional training device having a plurality of usage possibilities.

Further advantageous embodiments are evident from the following description, the claims, as well as the drawings.

DRAWINGS

Figure 2:
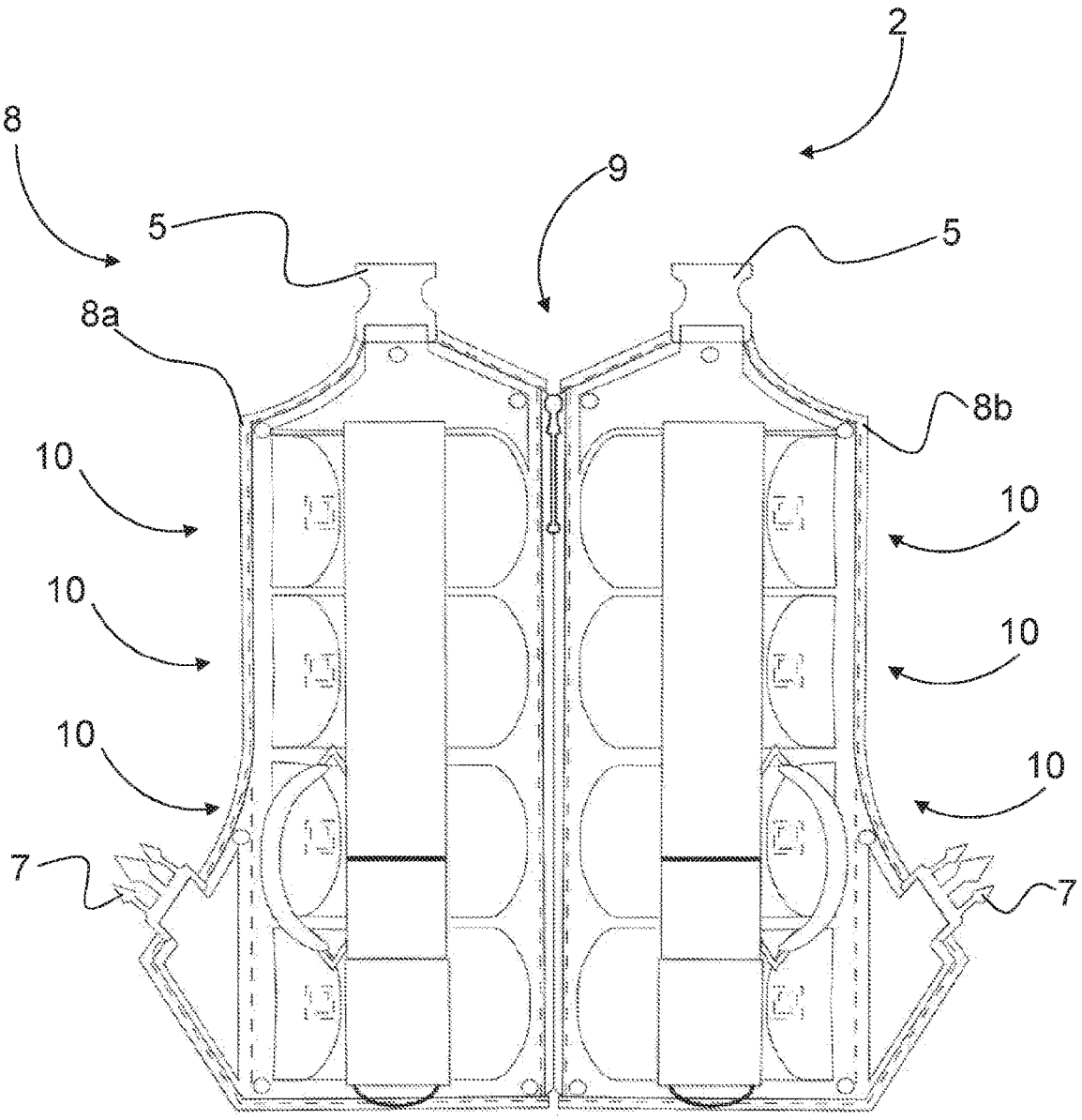
Figure 3:
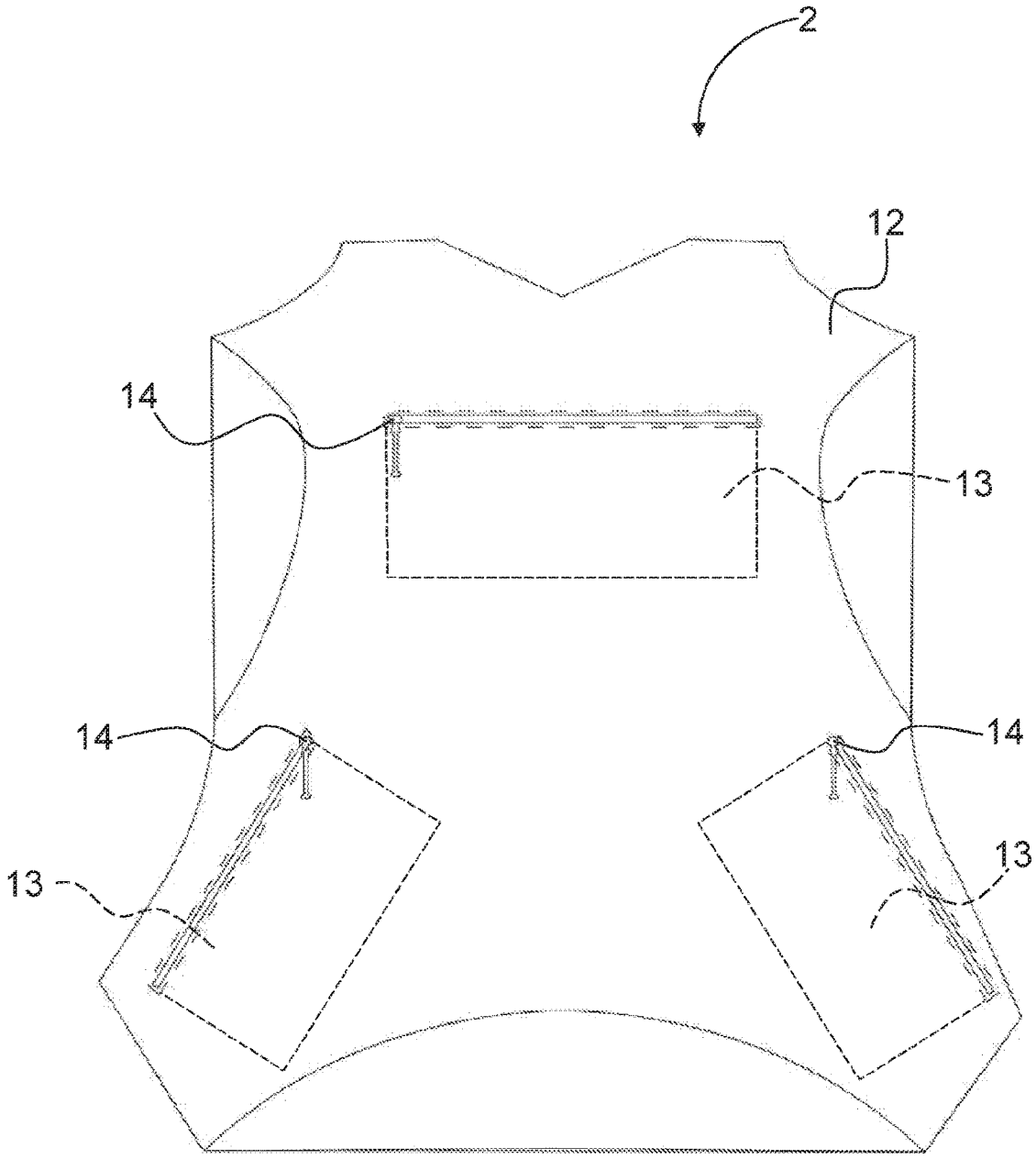
Figure 4:
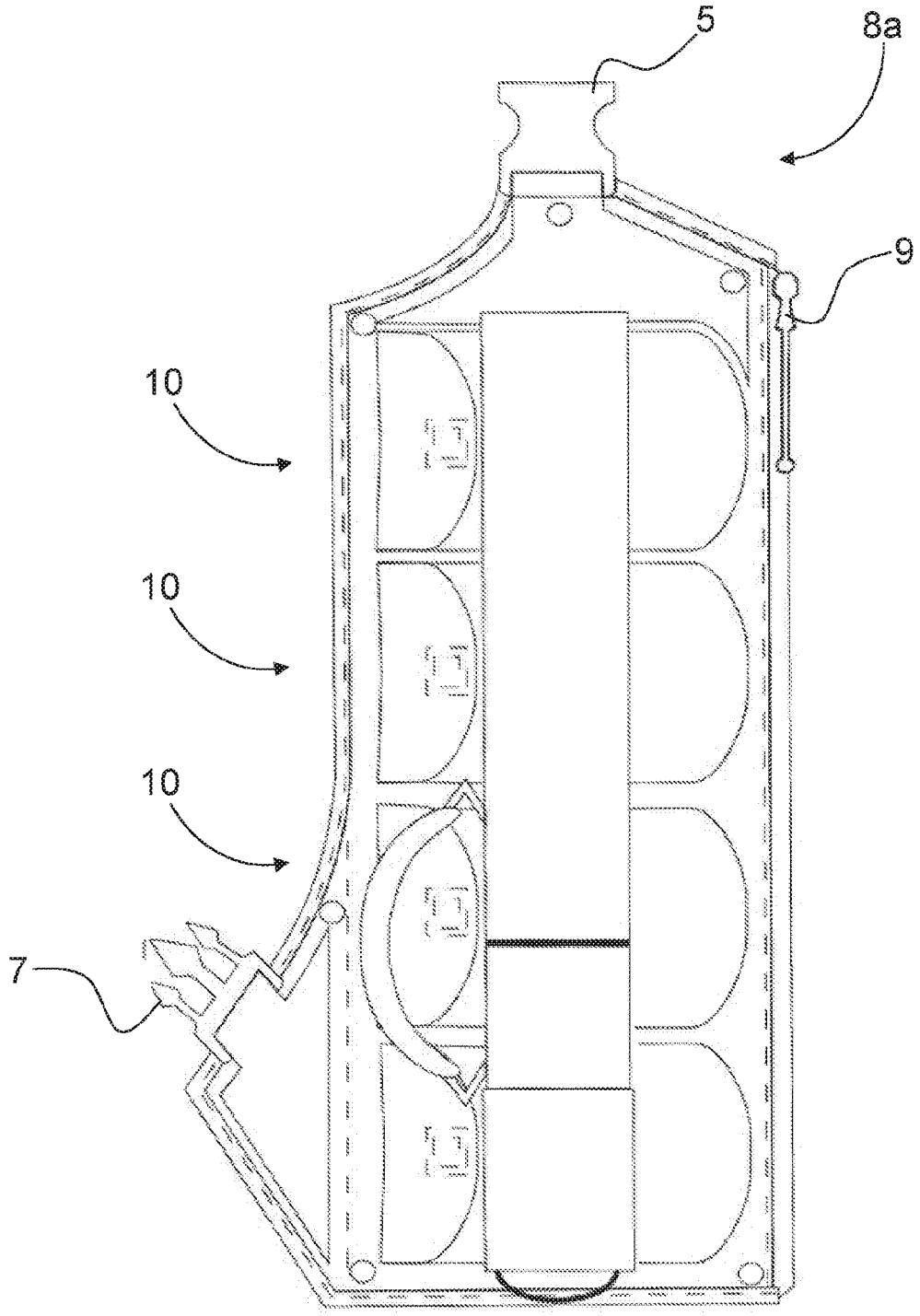
Figure 5:
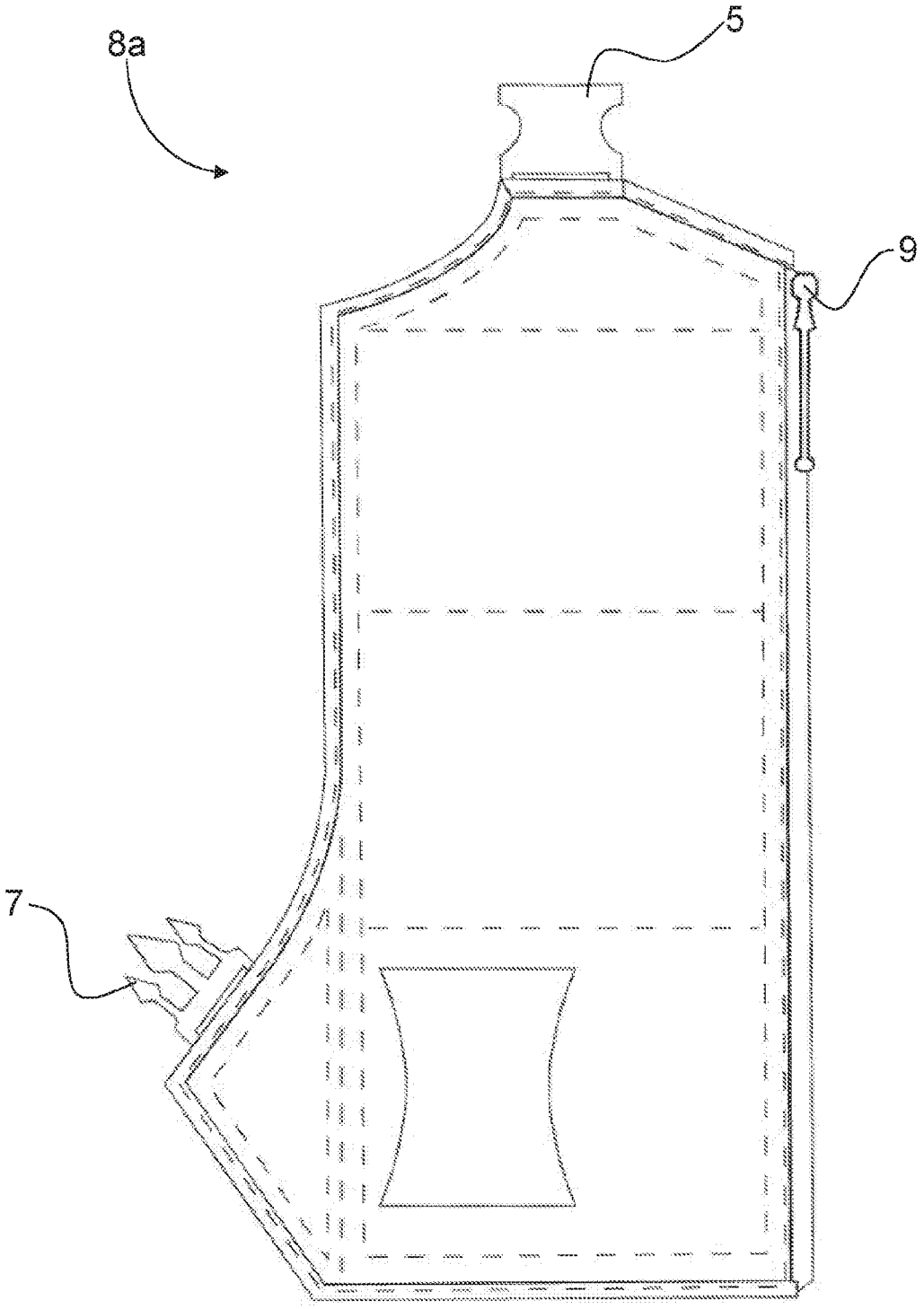
Figure 6:
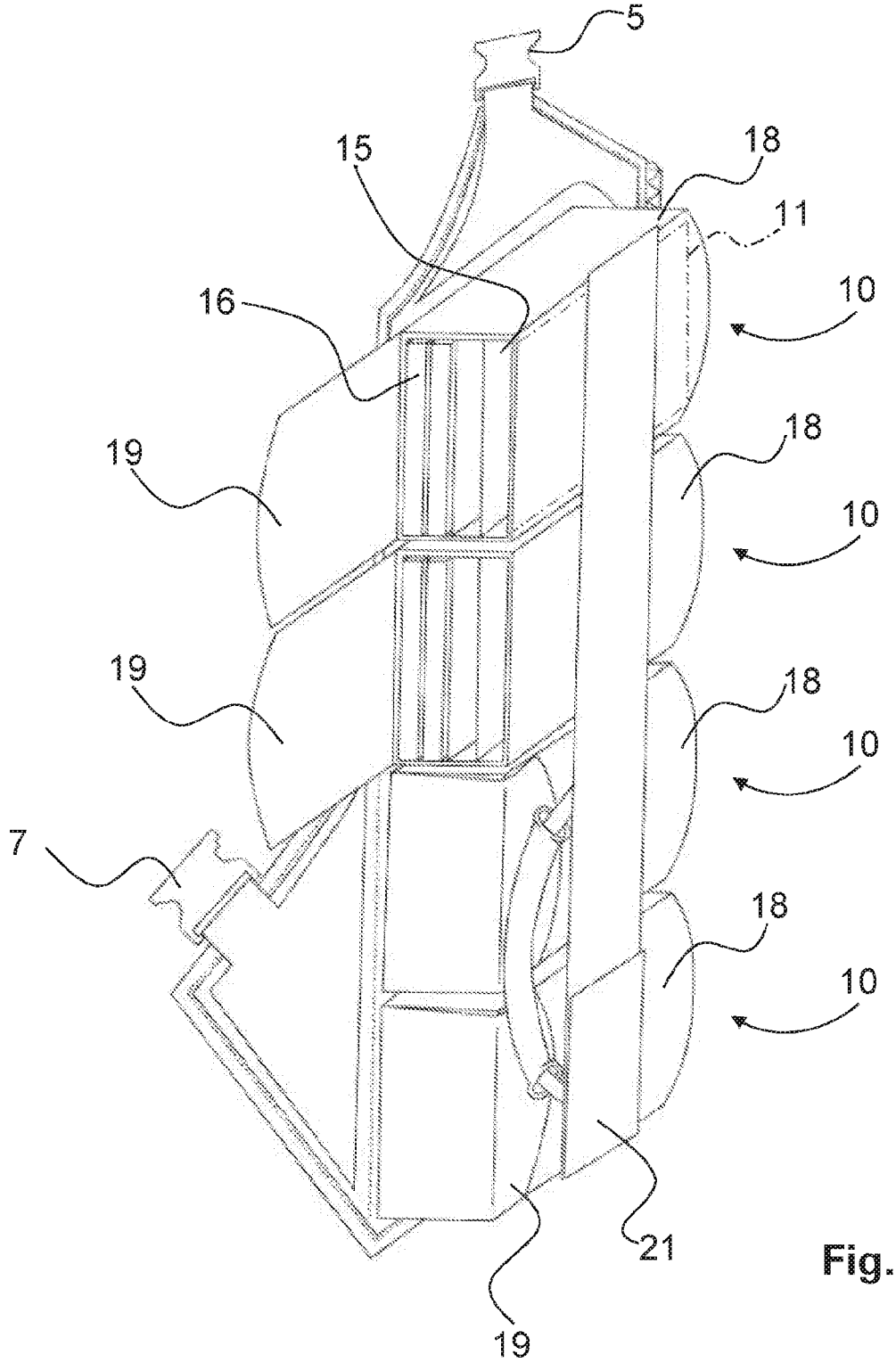
Figure 7:
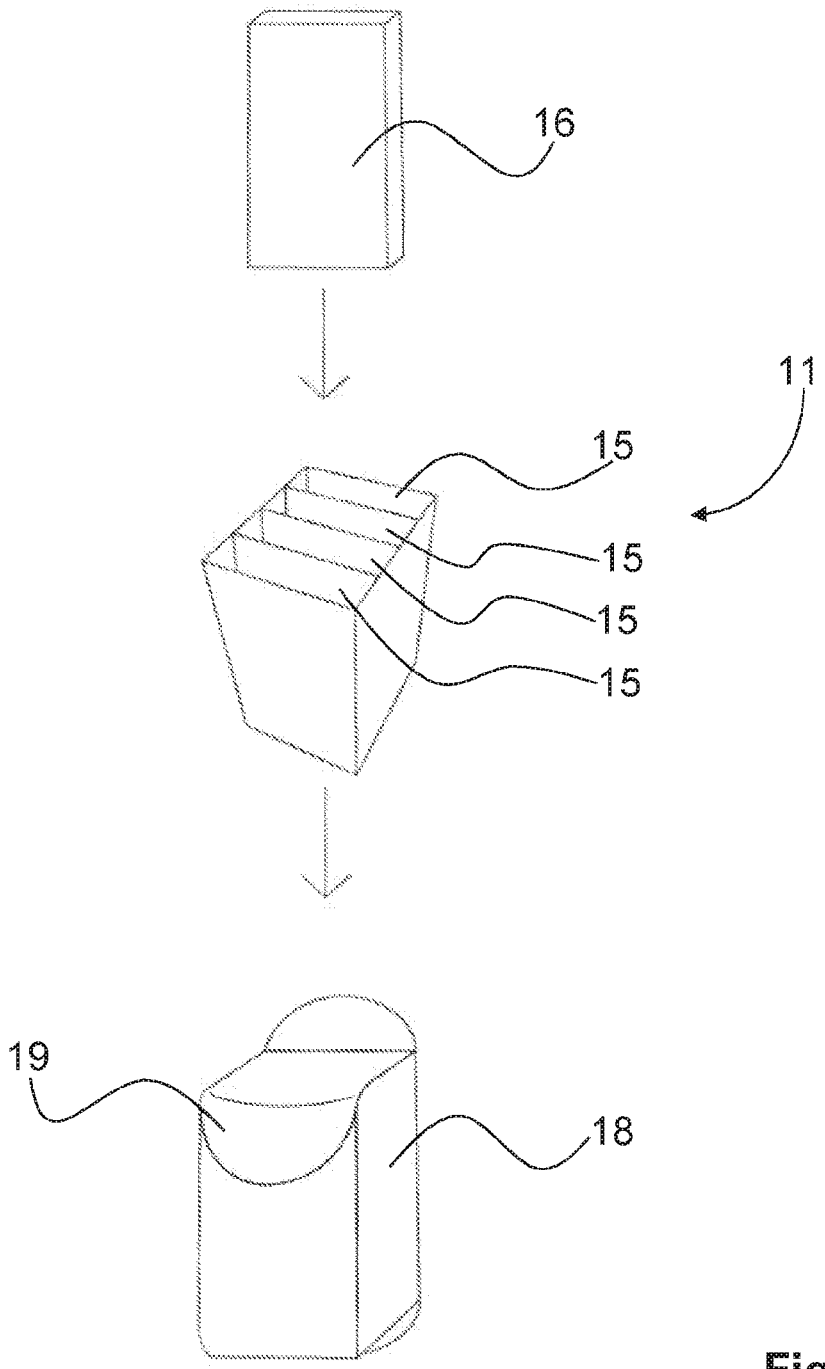
Figure 8:
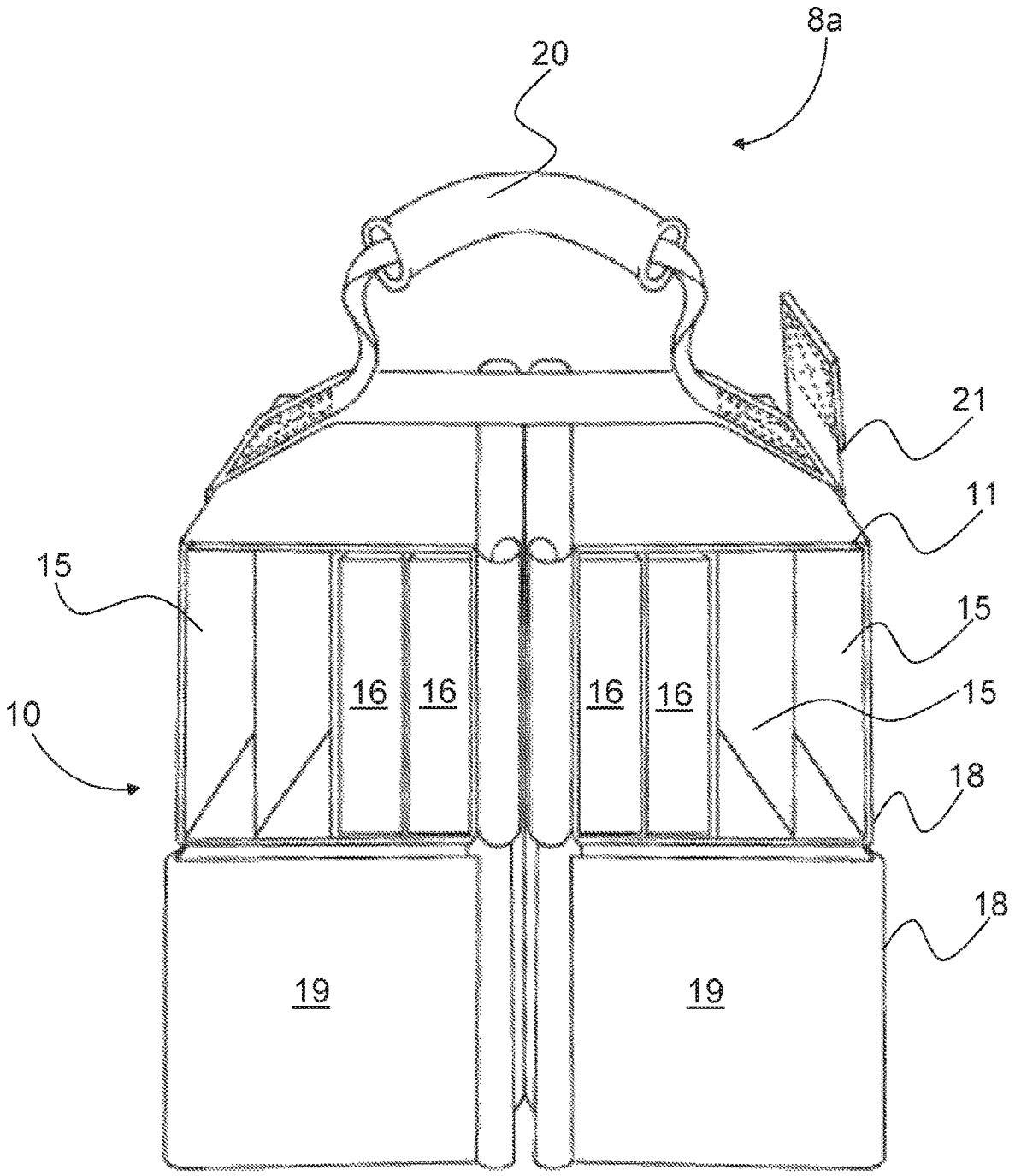
Figure 9:
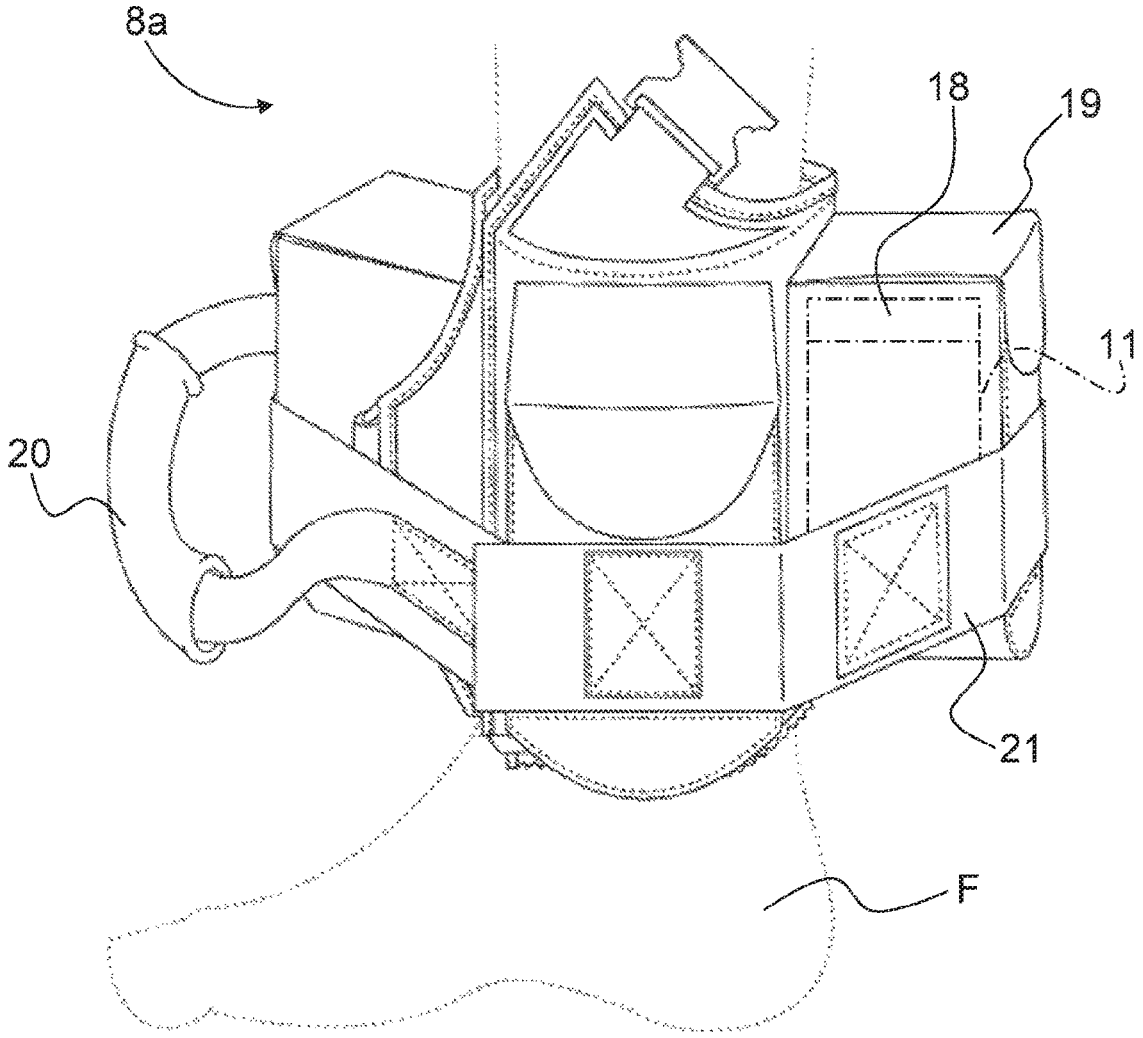

These show:

FIG. 1 a perspective view of the mobile training device having the back element and the carrying system;

FIG. 2 a top view of the mobile training device, namely the back element without the carrying system;

FIG. 3 a top view of a covering element for the mobile training device;

FIG. 4 a top view of a part of the mobile training device;

FIG. 5 a further top view of the part of the mobile training device according to FIG. 4;

FIG. 6 a perspective side view of the part of the mobile training device;

FIG. 7 a view of the containers for holding the weights;

FIG. 8 folded-together part of the mobile training device as a kettlebell;

FIG. 9 placement of the folded-together part of the mobile training device according to FIG. 8 on a foot.

DESCRIPTION OF THE EXEMPLARY EMBODIMENT

A mobile training device 1 is shown in FIG. 1. This training device 1 consists of a back element 2 and a carrying system 3. The carrying system 3 comprises shoulder straps 4, which are articulated onto the back element 2 by way of releasable fastening elements 5. The shoulder straps 4 correspond to the shoulder straps of backpacks. In addition, a hip belt 6 is provided, which can be releasably fixed in place on the back element 2 by way of one or more further fastening elements 7.

The back element 2 preferably consists of an ergonomically shaped plate 8. This plate 8 can consist of plastic or of a viscoelastic foam material or of a combination of the two. The back element 2 extends, in the case of a special embodiment, from the shoulder region to the groin region of a person. The back element 2 is comparable to a back element of a backpack.

The back element 2 in the configuration of the plate 8 can be divided into multiple plate parts. In the figures, in particular in FIG. 2, an exemplary embodiment is shown that comprises a first plate part 8*a* and a further plate part 8*b*. The two plate parts 8*a*, 8*b* are connected with one another by way of a connecting element 9, here a zipper, in releasable and thereby separable manner. By means of a covering element 12, as shown in FIG. 3, the back element 2 is protected against rain, for example. This covering element 12 is removable and can accordingly be affixed only when needed. Alternatively or also supplementally, it is provided that this covering element 12 comprises storage regions 13 for objects. Preferably, these storage regions 13 are provided with closure elements 14. These closure elements 14 can be zippers, for example.

A plate part 8*a*, 8*b*, shown in FIGS. 4 to 6, comprises at least one holding region 10 for holding a container 11. The container 11, as shown in FIG. 7, comprises one or more holding elements 15, which are suitable for holding weight plates 16. The individual weight plates 16 can be held in the holding elements 15 by means of magnets. Alternatively, and also as shown in the FIG., the container 11 encloses a pocket 18. Such a container 11 is fitted into this pocket. In order for the weight plates 16 not to fall out of the holding elements 15, the pocket 18 has a closable flap 19, which cover covers the opening regions of the containers 11 in the closed state, so that the weight plates 16 that have been introduced cannot fall out.

Alternatively, the containers 11 can have no subdivisions and thereby show only a single holding element 15. This element can then serve for the purpose that sand in a small bag, for example, can be introduced as a weight. The small bags of sand can also be introduced into the pockets 18 that are provided even without the containers. This feature is particularly advantageous if the training device is taken along on trips and the containers as well as the weight plates cannot be taken along for reasons of space and weight. However, by means of the technical design, it is nevertheless possible to use the training device, even without containers and weight plates.

Supplementally or alternatively, pockets 18 can be arranged on the carrying system 3, which pockets hold weights, for example in the form of weight plates 16, or containers 11 in connection with plates or weight bags, for example comprising sand or stones. Placement can take place by means of hook-and-loop closures, magnets or alternative methods of fastening.

The hip belt 6 has holding regions 10 for holding weights. These holding regions 10 are structured in such a manner that magnets fix the weights arranged on the hip belt 6 in place. Alternative fastening means and also small containers, preferably consisting of textile material, are conceivable.

An example of use of the training device 1 is shown in FIGS. 8 and 9. A plate part 8*a*, as shown in FIG. 6, is folded in half, so that a kind of kettlebell is formed. This configuration can be equipped with different weight plates 16, as shown in FIG. 8. A fixation element 21 serves for the purpose of holding the folded-up plate part 8*a* together. This fixation element 21 is preferably a hook-and-loop strip. By means of the frequent folding, two containers 11, in each instance, are arranged symmetrically to one another. The containers 11 can be filled with a different number of weight plates 16. If no container 11 is used, the holding elements 15, which actually hold the containers 11, offer the possibility of holding sand that has been filled into small bags, for example, as a weight. A handle element 20 allows lifting the weight and performing corresponding exercises.

Alternatively, the fixation element 21 can also be used for the purpose of affixing the plate part 8*a* to a foot F by being wrapped around the latter.

By means of the mobile training device 1, a training and fitness utensil has been created, with which many different exercises can be performed independent of the location and, in particular, also during transport of the training device. The training device 1 can be divided into different functional elements in very simple manner, so that two kettlebells, for example, can be made available, which can be moved by means of a handle element or affixed to a body part, for example a foot, by means of a fixation element. A fitness backpack that can be used outdoors, in particular by personal trainers and their clients, is created by means of affixing one or more containers, optionally changing weight plates, and replacing the weight plates and the containers with bags that can be filled with natural weights such as sand and stones.

REFERENCE SYMBOL LIST

Mobile Training Device for Holding Weights

1 training device

2 back element

3 carrying system

4 shoulder straps

5 fastening elements
6 hip belt
7 fastening elements
8 plate
8*a* plate part
8*b* plate part
9 connecting element
10 holding region
11 container
12 covering element
13 storage regions
14 closure element
15 holding elements
16 weight plates
17 --
18 pocket
19 flap
20 handle element
21 fixation element
F foot

The invention claimed is:

1. A mobile training device for persons, wherein the training device comprises:

a back element;

a carrying system having shoulder straps, releasably articulated onto the back element; and a plurality of magnets;

a. wherein the back element is divided in its longitudinal expanse, in such a manner that first and second plate parts are formed;

b. wherein the first and second plate parts are adapted to be divided into two mobile weights of equal size, for further performance of training exercises;

c. wherein each of the first and second plate or parts and/or the carrying system has at least one holding region that holds at least one weight;

d. wherein the at least one holding region comprises at least one container and the at least one container has at least one holder adapted to hold the at least one weight;

e. wherein the at least one weight comprises a plurality of weight plates; and f. wherein each weight plate of the weight plates is held in a respective holder by a respective magnet of the magnets.

2. The training device according to claim 1, wherein the first plate part comprises at least one fastener, which surrounds the first plate part and fixes the first plate part in place.

3. The training device according to claim 1, wherein the respective holder has the respective magnet for fixing the weight plates in place.

4. The training device according to claim 1, wherein the first plate part has at least one handle element.

* * * * *